United States Patent [19]

Tuttle

[11] Patent Number: 5,020,283

[45] Date of Patent: Jun. 4, 1991

[54] POLISHING PAD WITH UNIFORM ABRASION

[75] Inventor: Mark E. Tuttle, Boise, Id.

[73] Assignee: Micron Technology, Inc., Boise, Id.

[21] Appl. No.: 562,288

[22] Filed: Aug. 3, 1990

Related U.S. Application Data

[63] Continuation-in-part of Ser. No. 468,348, Jan. 22, 1990.

[51] Int. Cl.[5] ..... B24B 7/22

[52] U.S. Cl. ..... 51/209 DL; 51/209 R; 51/DIG. 34; 51/131.3; 51/395

[58] Field of Search ..... 51/395, 398, 406, 407, 51/283 R, 283 E, 206 P, 209 R, 209 DL, 266, 124, 131.1-131.5, 125, 109 R, DIG. 34

[56] References Cited

U.S. PATENT DOCUMENTS

| | | | |
|---|---|---|---|
| 2,409,953 | 10/1946 | Posh | 51/133 |
| 3,495,362 | 2/1970 | Hillenbrand | 51/395 |
| 3,517,466 | 1/1970 | Bouvier | 51/DIG. 34 |
| 4,663,890 | 5/1987 | Brandt | 51/283 R |

*Primary Examiner*—Frederick R. Schmidt
*Assistant Examiner*—Blynn Shideler
*Attorney, Agent, or Firm*—Stanley N. Protigal; Angus C. Fox, III

[57] ABSTRACT

A polishing pad for semiconductor wafers, having a face shaped by a series of voids. The voids are substantially the same size, but the frequency of the voids increases with increasing radial distance to provide a constant, or nearly constant, surface contact rate to a workpiece such as a semiconductor wafer, in order to effect improved planarity of the workpiece.

8 Claims, 5 Drawing Sheets

POLISHING PAD WITH UNIFORM ABRASION

CROSS-REFERENCE TO RELATED APPLICATION

This is a continuation-in-part to U.S. patent application Ser. No. 7/468,348, filed Jan. 22, 1990.

BACKGROUND OF THE INVENTION

1. Field of the Invention

This invention relates to the grinding or polishing of a workpiece, in particular the polishing of a semiconductor wafer surface to a high degree of planarity.

2. Description of the Related Art

In the manufacture if integrated circuits, for example, planarity of the underlying semiconductor substrate or wafer is very important. Critical geometries of integrated circuitry are presently in the neighborhood of less than 1 micron. These geometries are by necessity produced by photolithographic means: an image is optically or electromagnetically focused and chemically processed on the wafer. If the wafer surface is not sufficiently planar, some regions will be in focus and clearly defined, and other regions will not be defined well enough, resulting in a nonfunctional or less than optimal circuit. Planarity of semiconductor wafers is therefore necessary.

Chemical and mechanical means, and their combination (the combination being known as "mechanically enhanced chemical polishing"), have been employed, to effect planarity of a wafer. In mechanically enhanced chemical polishing, a chemical etch rate on high topographies of the wafer is assisted by mechanical energy.

FIGS. 1*a* and 1*b* illustrate the basic principles used in prior art mechanical wafer polishing. A ring-shaped section of a polishing pad rotates at $W_p$ radians per second (R/s) about axis O. A wafer to be polished is rotated at $W_W$R/s in the opposite sense. The wafer may also be moved in directions +X and −X relative to O, the wafer face being pressed against the pad face to accomplish polishing. The pad face may not itself be abrasive. Actual removal of surface material from the wafer is often accomplished by a mechanically abrasive slurry, which may be chemically assisted by an etchant mixed in with the slurry.

FIG. 2 helps to clarify rotation $W_W$ and the ring shape of the pad in FIG. 1. For a generic circular pad rotating at W R/s, the linear speed of the polishing face at any given radius will vary according to the relationship $L=W\times R$, where L is in cm/s for W in R/s and R in cm. It can be seen, for example, that linear speed $L_2$ at large radius $R_2$ is greater than linear speed $L_1$ at small radius $R_1$. Consider now that the pad has a surface contact rate with a workpiece that varies according to radius. Portions of a workpiece, such as a wafer, contacting the pad face at radius $R_1$ experience a surface contact rate proportional to $L_1$. Similarly, portions of the wafer contacting the pad face at radius $R_2$ will experience a surface contact rate proportional to $L_2$. Since $L_2>L_1$, it is apparent that a workpiece at radius $R_2$ will receive more surface contact than a workpiece at radius $R_1$. If a wafer is large enough in comparison to the pad to be polished at both $R_1$ and $R_2$, the wafer will be polished unevenly: the portions of the wafer at $R_2$ will be polished faster than the portions of wafer at $R_1$. The resulting non-planarity is not acceptable for high precision polishing required for semiconductor wafers.

Referring again to the prior art of FIG. 1, a common approach by which prior art attempts to overcome non-uniform surface contact rate is by using a ring-shaped pad or the outer circumference of a circular pad, to limit the difference between the largest usable radius and smallest usable radius, thus limiting surface contact rate variation across the pad face, and by moving the wafer and negatively rotating it, relative to the pad and its rotation. The combination is intended to limit the inherent variableness of the surface contact rate across the wafer, thereby minimizing non-planarity. Such movement of the wafer with respect to the polishing pad's axis of rotation requires special gearing and design tolerances to perform optimally.

It is an object of the present invention to provide a polishing pad capable of providing a substantially constant, radially independent surface contact rate, improving planarity of a workpiece polished thereby.

SUMMARY OF THE INVENTION

According to the invention, a polishing pad is provided, having its face shaped to provide a constant, or nearly constant, surface contact rate. One configuration is a rotatable circular pad having a face formed into sunburst pattern with nontapered rays. The sunburst pattern is coaxial with the pad's rotation.

In manufacturing the pads, the change in size of the voids across the radius of the pad is inconvenient. According to another aspect of the invention, the number of voids per unit area is increased as the radius increases, while keeping the void size constant. This results in a relatively constant abrasive surface arc length within a predetermined working area of the pad.

The increased number of voids per unit area along circumferences defined by progressively increasing radii from an axis of rotation results in a relatively constant abrasion contact across a working area of the pad.

Alternate face patterns are also disclosed, each providing a nearly constant surface contact rate.

DETAILED DESCRIPTION OF THE PREFERRED EMBODIMENT

Figure 1A:
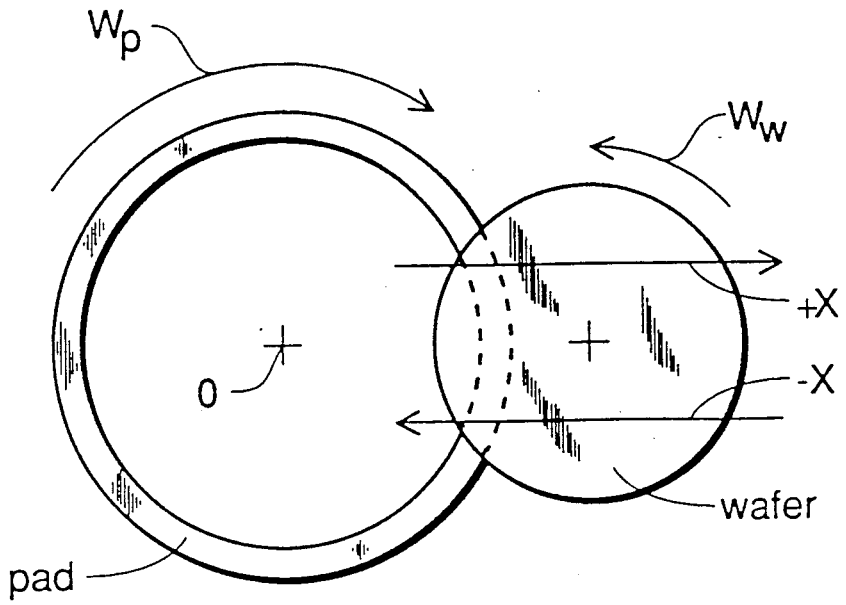
FIG. 1A (PRIOR ART)
FIGS. 1*a* and 1*b* are elevational and side views of an illustrative prior art polishing pad implementation.
Figure 1B:
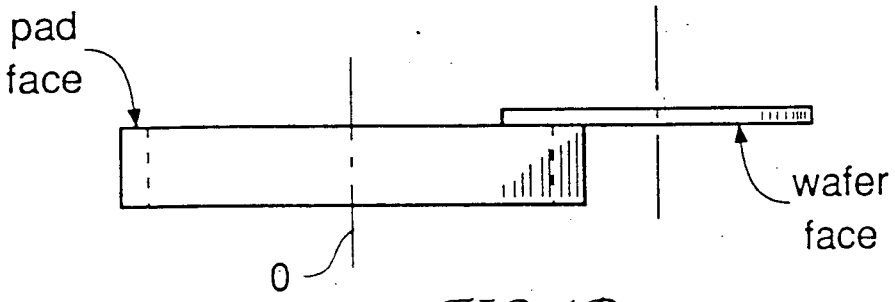
FIG. 1B (PRIOR ART)
Figure 2:
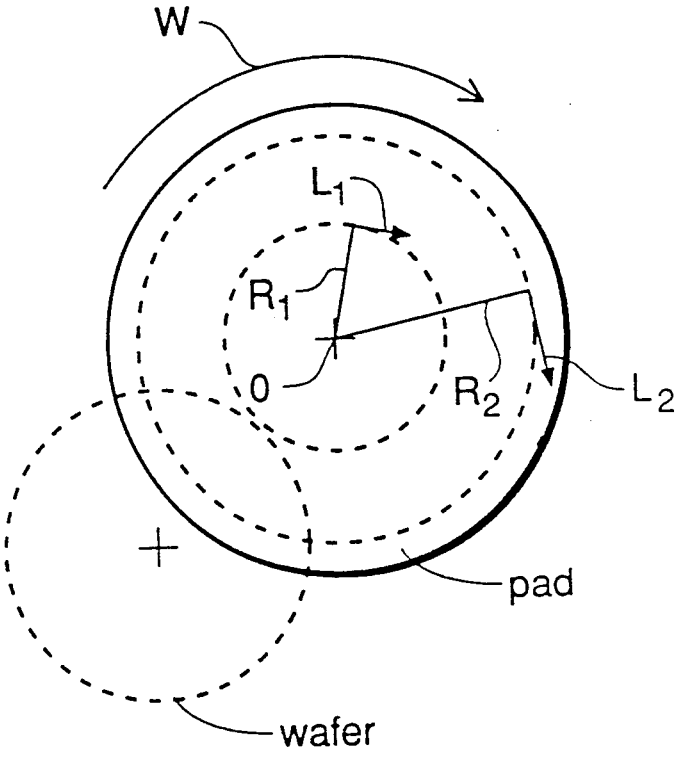
FIG. 2 illustrates different linear velocities for different radii on a generic polishing pad.
Figure 3:
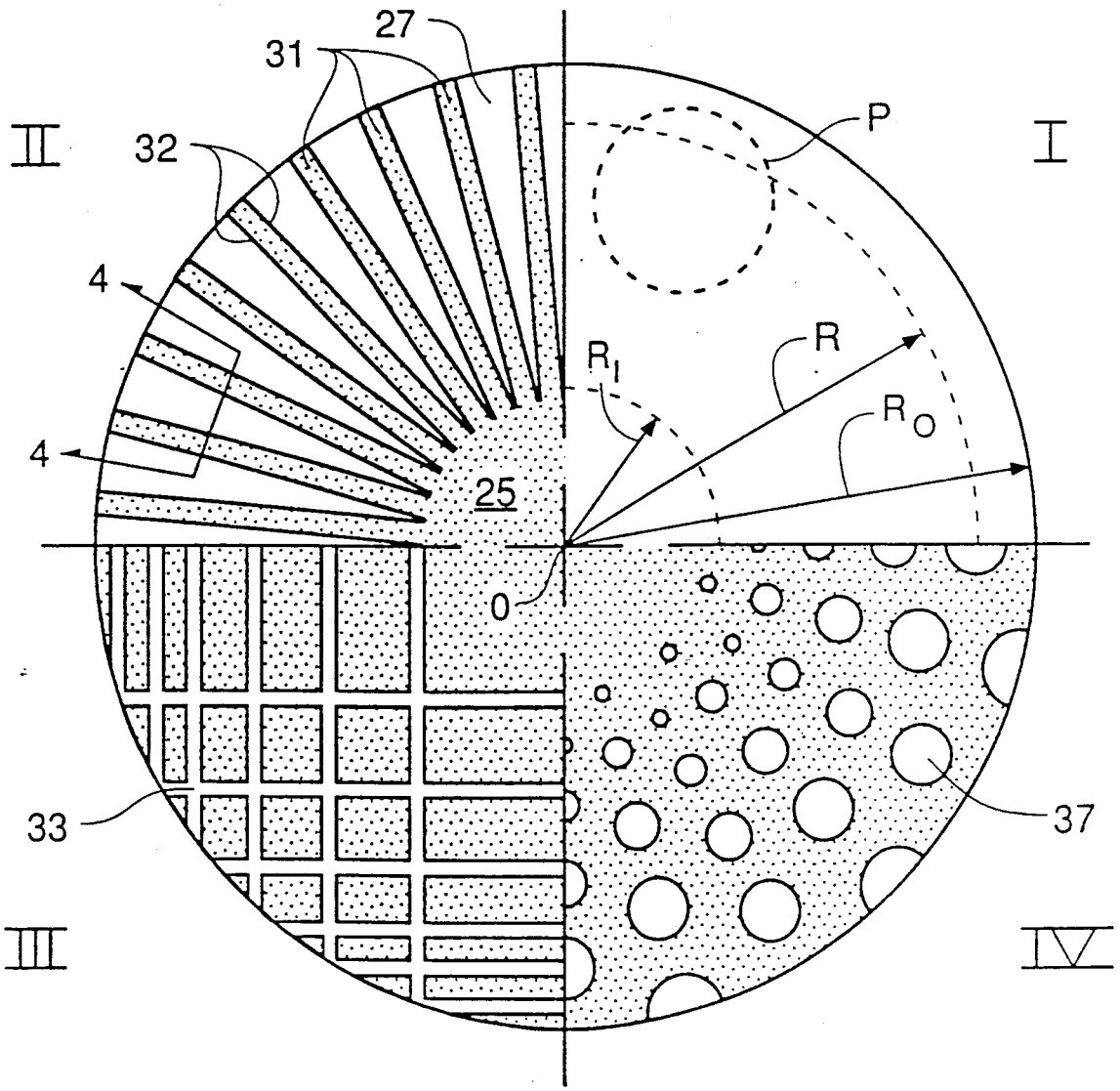
FIG. 3 shows different configurations for the inventive polishing pad.
Figure 4:
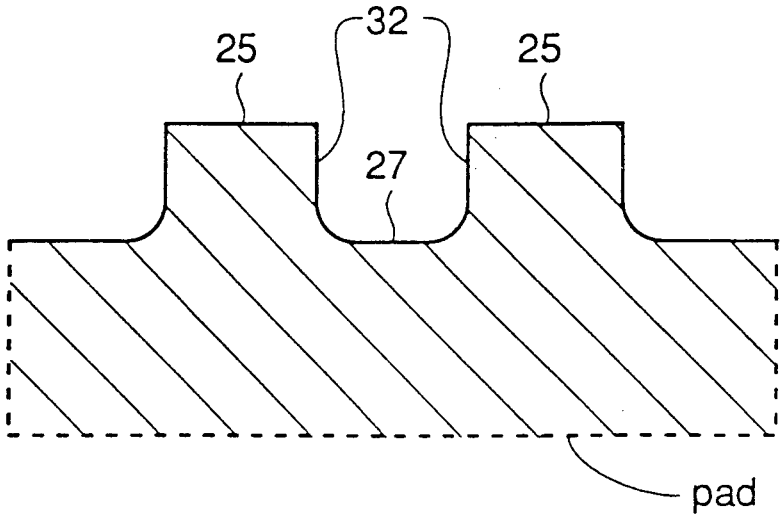
FIG. 4 is a cross-section along line 4—4 of FIG. 3.

FIG. 3 shows different embodiments of the invention. With reference to FIGS. 3 and 4, a polishing pad face 25 is interrupted with voids 27. The voids 27 form the polishing pad face 25 into rays 31, each having parallel edges 32 (nontapered). Rays 31 meet each other at radius $R_1$, and continue outward to $R_0$, as shown in quadrant I.

Because rays 31 have parallel edges 32, a workpiece P that is stationary with reference to the polishing pad's axis of rotation O will experience the same surface contact rate at any radius R between $R_1$ and $R_0$. Planarity across the finished surface of P is therefore obtainable without movement of workpiece P with respect to O, simply by pressing P against the pad face within the bounds of $R_1$ and $R_0$.

Quadrant III of FIG. 3 shows grooves 33 formed in the pad face such that a distance between any two grooves is oppositely related to the radius from O of the inner of the two grooves—that is, the distance between any two grooves decreases with increasing radius. The grooves so arranged are able to provide a constant surface contact rate between $R_1$ and $R_0$. Two orthogonal series of parallel grooves are shown in quadrant III.

As shown in quadrant IV, circular voids 37 govern the pad face to achieve the same inventive effect. The voids are formed in the pad face such that the size of any void is cooperatively related to its radius from O—that is, void size increases with increasing radius.

Figure 5:
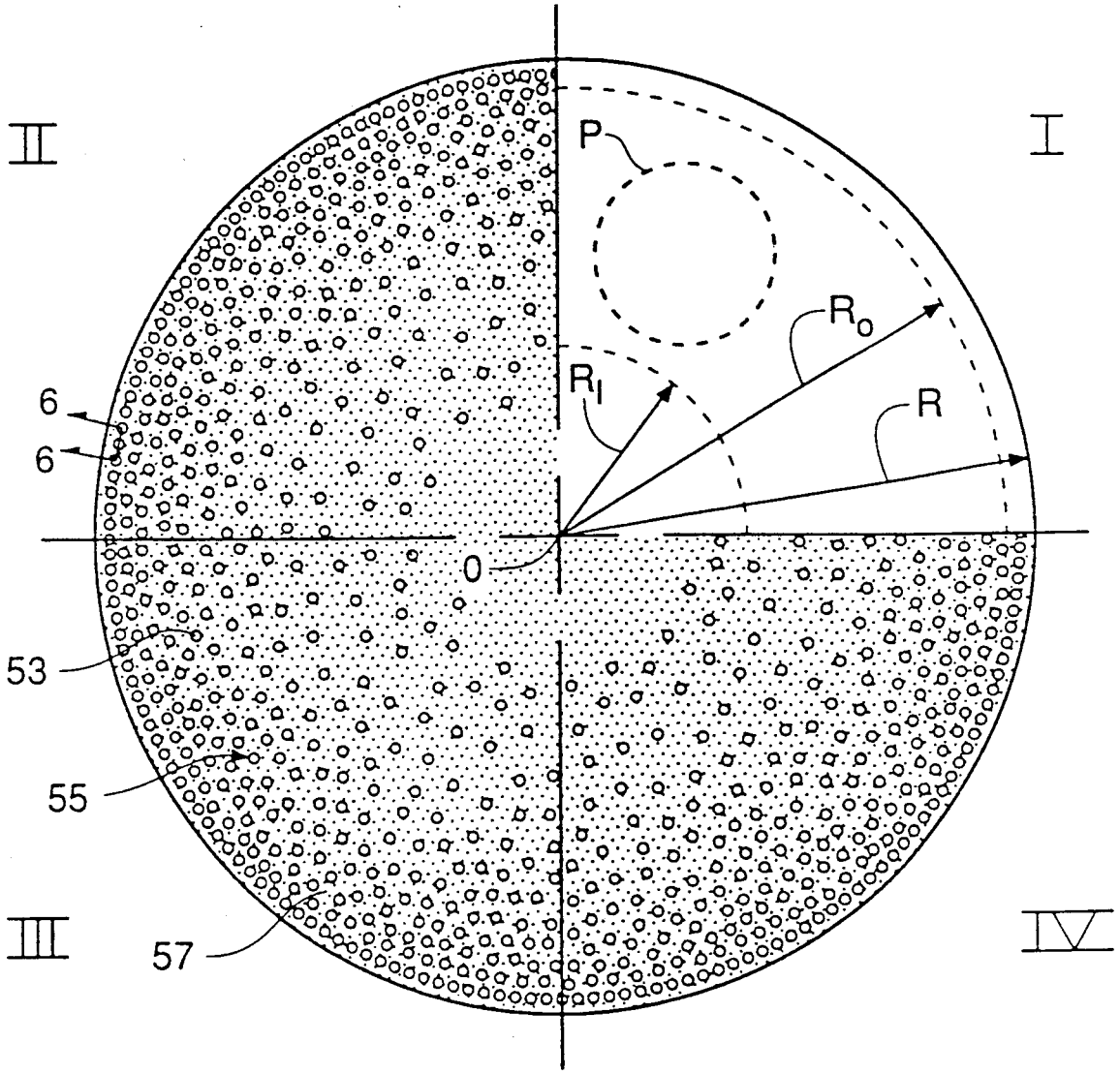
FIG. 5 shows a preferred embodiment of the inventive polishing pad.

In manufacturing the pads, the change in size of the voids across the radius of the pad is inconvenient. An alternative way to achieve the inventive effect is to increase the number of voids per unit area as the radius increases, while keeping the void size constant. As shown in FIG. 5, circular voids 50 may be substantially the same size across the radius of the pad. The number of voids along a given length of arc drawn at a given radius increase sufficiently to provide a constant surface contact rate between RI and RO. Thus, a variation in void density is achieved across the pad, without changing the size of the voids.

While the voids 40 are shown as depressions, it is also possible to provide the holes as extending entirely through the pad (not shown).

Figure 6:
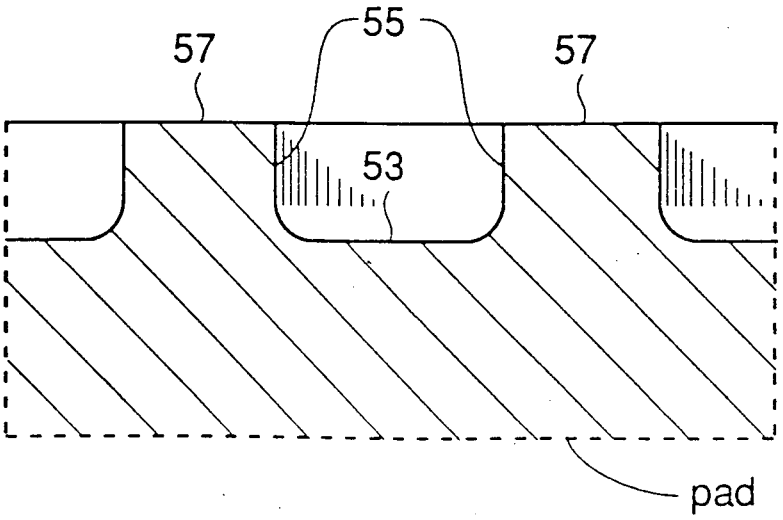
FIG. 6 is a cross-section along line 6—6 of FIG. 5.

As can be seen in the cross-sectional view of FIG. 6, the voids 50 are depressions 53 between sidewalls 55. This leaves a surface 57 between the voids 50. By varying the density of the voids, the total surface 57 around any given circumference, defined by a constant radius R, can be established.

Likewise, a plurality of grooves can be cut so that each groove extends toward $R_1$, but the grooves extend from different distances from the axis of rotation O.

I wish it to be understood that the term "polish" as used herein circumscribes abrasive activity such as grinding or polishing, by use of: slurry; abrasive grains embedded in the polishing pad face; chemical means; mechanically enhanced chemical polishing; or any combination thereof. It should also be understood that I consider my invention to have utility with workpieces of varying constituency, including semiconductors (such as silicon, germanium, and Group III–V semiconductors such as gallium arsenide), and optical materials (such as glass), among others. Further, although only five face patterns are disclosed herein, I wish it to be understood that I consider my invention to include any polishing pad face pattern capable of providing a constant or nearly constant surface contact rate to a workpiece. As is known in the art of polishing, it is further possible to rotate the pad at a second axis to generate an orbital polishing effect, which effectively shifts the center axis O.

I claim:

1. Apparatus to polish a workpiece, comprising:

a polishing pad, rotatable about an axis and having a face perpendicular to and coaxial with said axis;

said face, in use, to be urged against the workpiece to facilitate polishing of same;

said face shaped by a plurality of like shaped substantially circular voids; and each said void having a radius, wherein the radius of that void increases with the distance of that void from said axis, whereby said face is configured to be able to provide to the workpiece a surface contact rate having a magnitude independent of radius from said axis.

2. The apparatus of claim 1, wherein said surface contact rate is constant, or nearly so, for any radius bounded by an inner radius and an outer radius.

3. The apparatus of claim 2, wherein said inner and outer radii are sufficiently different to accommodate the workpiece between them.

4. The apparatus of claim 2, wherein the workpiece is a semiconductor wafer.

5. Apparatus to polish a workpiece, comprising:

a polishing pad, rotatable about an axis and having a face perpendicular to and coaxial with said axis;

said face, in use, to be urged against the workpiece to facilitate polishing of same;

said face shaped by a plurality of like sized substantially circular voids; and said voids having a density within a work zone between radii from said axis which increases with the distance of the voids from said axis, wherein said face, by virtue of its shape, is able to provide a constant, or nearly so, surface contact rate to the workpiece for any radius bounded by an inner radius and an outer radius from said axis, said radii being sufficiently different to accommodate the workpiece between them.

6. The apparatus of claim 5, wherein the workpiece is a semiconductor wafer.

7. Apparatus to polish a workpiece, comprising:

a polishing pad, rotatable about an axis and having a face perpendicular to and coaxial with said axis;

said face, in use, to be urged against the workpiece to facilitate polishing of same, said face shaped by a plurality of like sized substantially circular voids; and voids having a density within a work zone between radii from said axis which increases with the distance of the voids from said axis, whereby said face is configured to be able to provide to the workpiece a surface contact rate having a magnitude independent of radius from said axis, and in use, is urged against the workpiece to facilitate polishing of same, and wherein said face, by virtue of its shape, is able to provide a constant, or nearly so, surface contact rate to the workpiece for any radius within the work zone, said radii being sufficiently different to accommodate the workpiece between them.

8. The apparatus of claim 7, wherein the workpiece is a semiconductor wafer.

* * * * *